US006578739B2

(12) United States Patent
Scheifele

(10) Patent No.: US 6,578,739 B2
(45) Date of Patent: Jun. 17, 2003

(54) MULTI-CHAMBER TUBE WITH TWISTED INTERNAL PARTITION

(75) Inventor: Fredy Scheifele, Frauenfeld (CH)

(73) Assignee: KMK Lizence Ltd., Port Louis (MU)

( * ) Notice: Subject to any disclaimer, the term of this patent is extended or adjusted under 35 U.S.C. 154(b) by 0 days.

(21) Appl. No.: 09/759,738

(22) Filed: Jan. 16, 2001

(65) Prior Publication Data

US 2002/0023934 A1 Feb. 28, 2002

(30) Foreign Application Priority Data

Aug. 22, 2000 (CH) ..... 1629/00

(51) Int. Cl.[7] ..... B65D 35/22
(52) U.S. Cl. ..... 222/94
(58) Field of Search ..... 222/94

(56) References Cited

U.S. PATENT DOCUMENTS 5,244,120 A * 9/1993 O'Meara ..... 222/94
5,927,550 A * 7/1999 Mack et al. ..... 222/94
5,941,420 A * 8/1999 Connan ..... 222/94

* cited by examiner

*Primary Examiner*—Ehud Gartenberg
*Assistant Examiner*—Melvin A. Cartagena
(74) *Attorney, Agent, or Firm*—Bachman & LaPointe, P.C.

(57) ABSTRACT

In a multi-chamber tube in which a partition extending longitudinally through the body portion of the tube divides the interior thereof into the plurality of chambers each for containing respective substances to be discharged in combination from the tube, unwanted fluctuations in the amount of substances discharged from the tube can be reduced by the partition extending through the tube at an angle relative to the closure seam at the filling opening at the bottom of the tube.

3 Claims, 4 Drawing Sheets

MULTI-CHAMBER TUBE WITH TWISTED INTERNAL PARTITION

FIELD OF THE INVENTION

Figure 1:
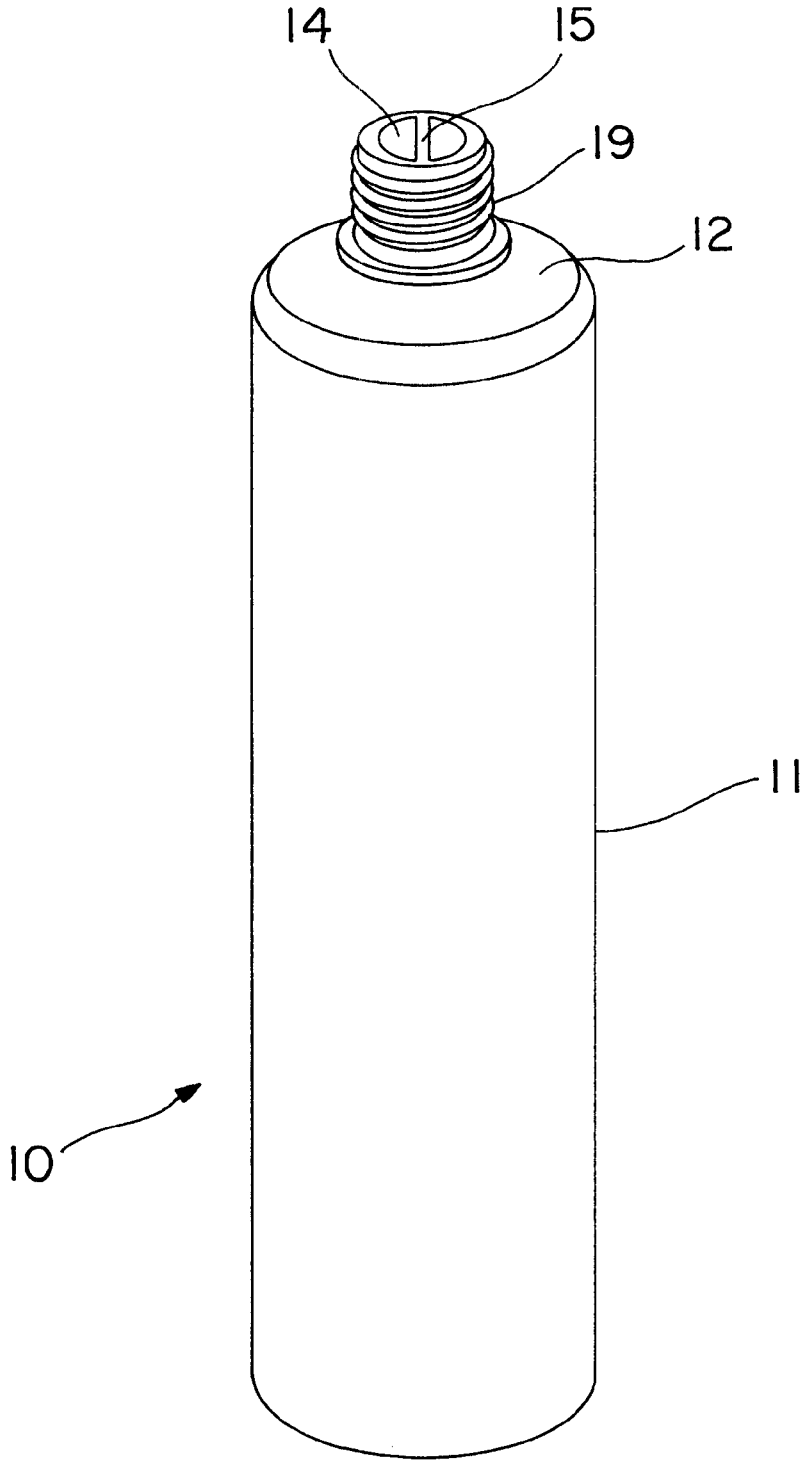

The invention concerns a multi-chamber tube for packaging a plurality of substances and dispensing them in conjunction with each other.

BACKGROUND OF THE INVENTION

The term multi-chamber tube is used herein to denote a packaging tube which includes at least two chambers for keeping packaged items or substances separately from each other. In the case of a two-chamber tube the chambers are formed by a divider wall or partition which is arranged within the body portion of the tube and which, starting from a bottom closure seam which extends perpendicularly to the longitudinal axis of the tube, passes in the longitudinal direction through the tube body portion with, arranged thereon, a tube head and a tube nozzle for discharge of the tube contents. In that case, the partition with its outer edges can be in engagement with the bottom closure seam, the internal peripheral surface of the tube body portion, an internal shoulder surface and the internal peripheral surface of the nozzle on the tube head. The foregoing reference to being in engagement means for example that the partition can simply bear with its outer longitudinally directed edges against the internal surfaces of the tube body portion, can bear thereagainst under a spring force or can be connected to the internal surface for example by welding or adhesive. If the partition is divided into a part in engagement with the tube body portion, which can thus be called the tube body portion part, and a part which is in engagement with the tube head, which can thus be called the tube head part, then a transverse edge of the tube body portion part, which extends in the diametral direction, can be connected as by welding to the bottom tube closure seam while the other edges are only in a condition of simply bearing against the respective surface, this being taken as an example to show that the tube body portion part including the transverse edge and the head part can respectively be in engagement with the walls of the tube body portion and the tube head in the same or different ways in accordance with the above-described possible options in a portion-wise manner. The choice of a variant out of the large number of different forms of connection between the partition and the tube body portion is determined to a considerable extent by the substances to be packaged. If for example two technical greases which do not chemically react with each other are to be simultaneously discharged from a two-chamber tube, then it is sufficient to provide a two-chamber tube with an inserted partition, the edges of which simply bear against the internal surface of the tube and the tube head. If in contrast packaged substances which are chemically reactive with each other are intended to be packaged and discharged simultaneously from the packaging tube, then this usually entails using multi-chamber tubes whose partition is fixedly connected for example by welding to the internal surface of the tube, more specifically at the transverse bottom closure seam, at the tube body portion, at the tube head with shoulder and at the tube nozzle.

Tubes of the configuration referred to herein, and more particularly their tube body portions for example, are made from plastic sheets or films comprising plastic materials which are suitable for packaging purposes. These can be polyethylenes, both of high and low density, polypropylenes, ethylene and propylene copolymers and polyethylene teraphthalates. The films or sheets can be in the form of laminates in which a gas-barrier layer of ethylene vinyl alcohol, polyamide or polyvinylidene chloride, or a metal film or sheet, preferably aluminum, is accommodated between layers of polyethylene, polypropylene or copolymers. The gas-barrier layer prevents the loss of certain ingredients of the packaged substances which, having passed into the gaseous phase, would diffuse through plastic films or sheets without a barrier layer. The barrier layer on the other hand also prevents gases from the environment outside the tube from having access to the packaged substances therein. Production of the tube body portions of plastic film or sheet is effected by shaping the film or sheet to form a tube body portion and welding the longitudinal edges of the film or sheet together.

Three procedures have proven successful in terms of fitting tube body portions with tube heads. In a first procedure a prefabricated tube head is connected to the tube body portion. A second procedure involves forming a tube head by injection molding on the tube body portion while a third procedure involves forming the head on the tube body portion by press shaping.

The plastic material for the heads corresponds to that of the films or sheets, or that of the outer cover layers of a laminate. In regard to the material for partitions, there is a wide range of different materials available; the materials that can be adopted, depending on the packaged substance, include papers, lined papers and plastic materials and also laminates, in which respect, in the case of plastic materials, they must be matched to the plastic materials of the tube body portions and heads if a partition is to be fixedly connected to a tube body portion and head, for example by welding.

The design of multi-chamber tubes, choice of material and production processes have advanced to such an extent that tubes are available, which may satisfactorily perform the functions attributed thereto such as keeping packaged substances separately and providing durability or shelf life of the packaged substances, but the discharge thereof may give rise to certain problems.

At this point consideration will be given as an analogy to extrusion devices intended for the production of items, starting for example from plastic material masses of a pasty or dough-like constitution. Continuous reproducibility of the extruded products depends to a substantial extent, having regard to the constancy involved, on the setting values at the apparatus, for example the temperature, the pressure and the uniformity of discharge of the material, that is to say the extrusion characteristics, which can also be referred to as 'metering capability', or, for the sake of brevity, 'metering', of the apparatus.

If now a single-chamber or multi-chamber tube is compared to an extrusion apparatus, it will be clear that uniformity of the discharge of material therefrom can scarcely be achieved, as a result for example of unavoidably fluctuating pressure loadings on the packaged substance in the tube body portion. This means that the characteristics which, on the basis of the above-mentioned analogy of extrusion devices, can be called the extrusion characteristics, of packaging tubes which are otherwise of a satisfactory design configuration in terms of the regular use thereof are unsatisfactory. The foregoing expression uniformity of the discharge of material means for example the discharge of a uniform amount per unit of time or emission of a mass consisting of two components, while maintaining for example the same proportions in terms of quantity and component. The fluctuating pressure loadings result from the pressure loadings which can be applied to the tube by thumbs and fingers of a human hand to respective substantially oppositely disposed surfaces of the wall of the tube body portion and which vary in terms of magnitude from one extrusion or material-discharge operation to another or which can build up or decrease during one extrusion or discharge procedure. The degrees to which the chambers are filled with their respective substances also exert a further and not inconsiderable influence on the extrusion characteristics. With a low level of filling of the chambers and when the loading begins, more specifically it is not possible to predict the flow direction, that is to say towards the head or towards the bottom closure seam of the tube, for the packaged substance therein. For example, in the case of multi-chamber tubes, the packaged substance in one chamber can initially move in opposite relationship to that in another chamber, and that adversely affects the required uniformity of the discharge of material.

The inability, in normal handling of the tube, to repeatedly discharge uniform amounts of packaged substance out of a single-chamber tube or a multi-chamber tube is often referred to in the language in the art for the sake of brevity as 'metering insufficiency'. This counts as a factor in particular against the multi-chamber tube as an emptiable container or packaging means for packaged substances which, stored therein in the form of components, are dispensed in combination only upon use in quantitative proportions which are definitively metered. Packaged substances involving that form of dispensation thereof are known in many different respects for technical, dental-hygiene, cosmetic and up to pharmaceutical purposes. At the present time they are predominantly packaged in component-wise manner in separate containers, in which respect calibration devices for equal quantitative metering are added to such containers.

This limited utility of tubes of the described configuration is found to be a further disadvantage.

SUMMARY OF THE INVENTION

An object of the invention is to provide a multi-chamber tube which can avoid the disadvantages of the prior tubes.

A further object of the invention is to provide a multi-chamber tube which can afford more accurately quantitatively controllable discharge of substances from the tube.

Still a further object of the invention is to provide a multi-chamber tube which can at least contribute to avoiding unwanted fluctuations in the discharge of component substances from the tube.

The foregoing and other objects are attained by a tube in accordance with the invention as set forth herein.

Further objects, features and advantages of the invention will be apparent from the description hereinafter of a preferred embodiment of the invention.

BRIEF DESCRIPTION OF THE INVENTION

Figure 4:
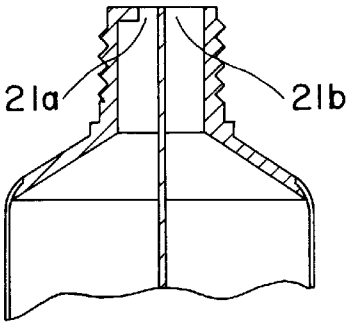
Figure 5:
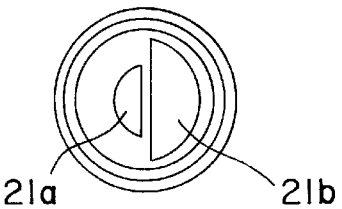
Figure 2:
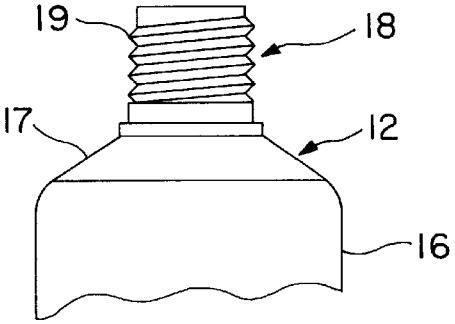
Figure 3:
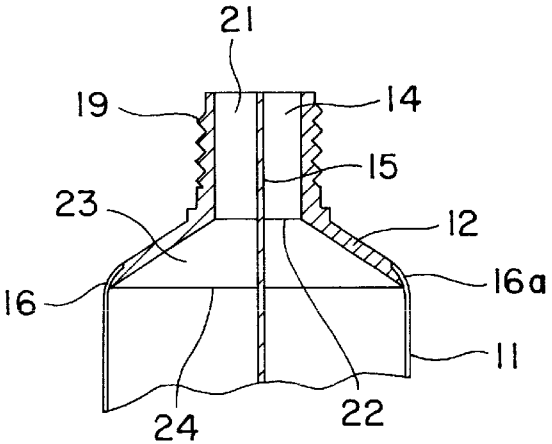
Figure 6:
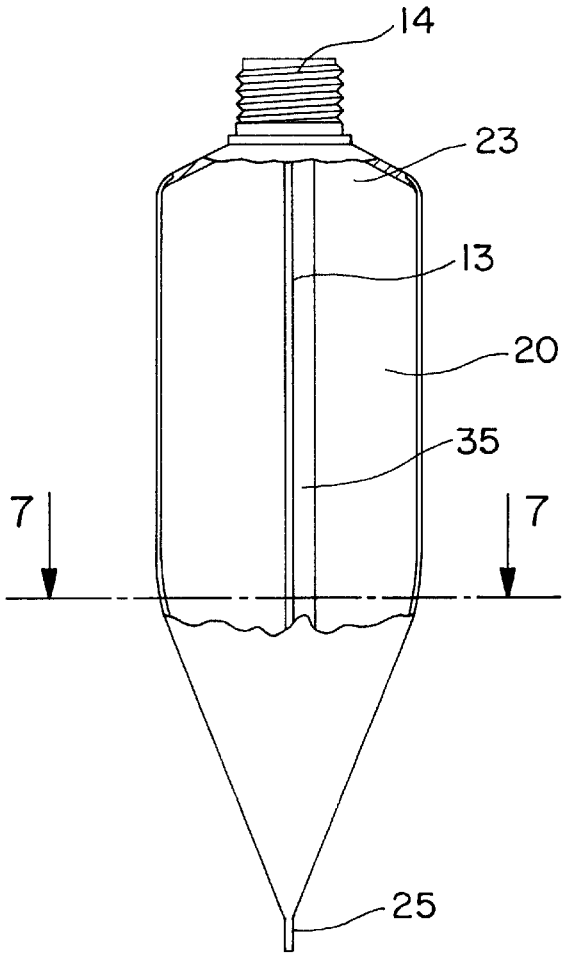
Figure 7:
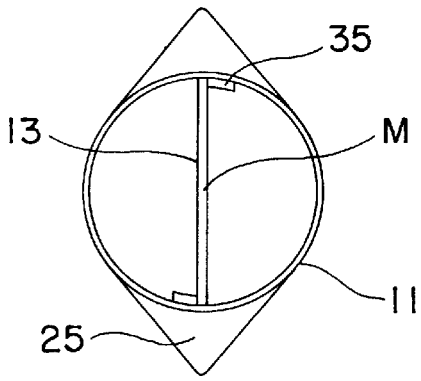
Figure 8:
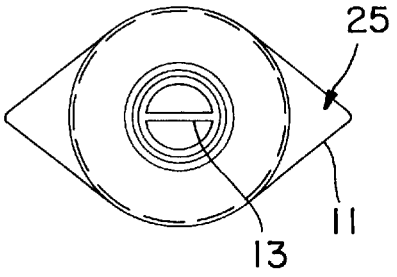
Figure 9:
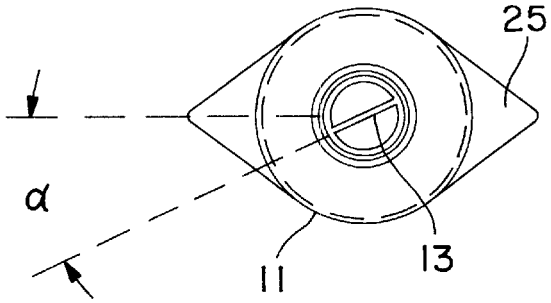
Figure 10:
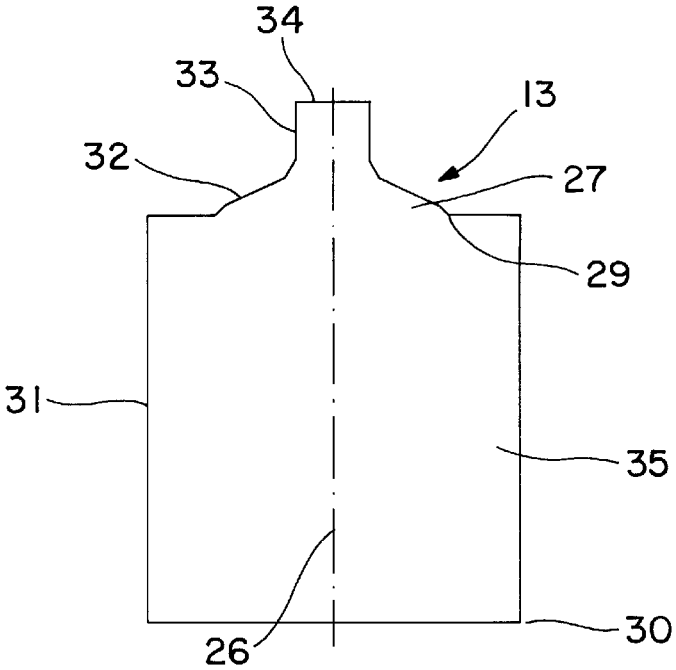

FIG. 1 is a perspective side view of a multi-chamber tube in accordance with the invention, which is unclosed at the bottom closure filling end, FIG. 2 is a side view showing as an individual part a tube head with a connecting edge, shoulder and tube nozzle, FIG. 3 is a side view in vertical section through the head of FIG. 2 with a separating wall or partition and a part fitted thereto of a tube body portion, FIG. 4 is a view in vertical section through the head shown in FIG. 2 illustrating nozzle openings of different dimensions, FIG. 5 is a plan view of a head as shown in FIG. 4, FIG. 6 is a side view, partly in section, of a tube as shown in FIG. 1 with the bottom closure filling end closed by a transversely extending tube closure seam which can also be referred to as the crimp, FIG. 7 is a plan view in section taken along section line A—A through the body portion of the tube shown in FIG. 6, intersecting the partition, FIG. 8 is a plan view of the tube head shown in FIG. 6, showing the part of the partition in the nozzle opening, FIG. 9 is a plan view of a tube as shown in FIG. 6 with a part of a partition disposed in an angular position relative to the crimp, and FIG. 10 is a view on to the face of a partition.

DESCRIPTION OF THE PREFERRED EMBODIMENT

Referring to FIG. 1, a multi-chamber tube 10 designed in accordance with the invention comprises a deformable tube body portion 11, a tube head 12 and divider configurations or partitions 13 which are accommodated in the tube body portion 11 and which divide the interior of the tube body portion 11 and the tube head 12 into a plurality of chambers which are closed off relative to each other. Described hereinafter by way of example as the multi-chamber tube 10, referred to for the sake of brevity hereinafter as the tube 10, is a two-chamber tube whose chambers are thus formed by a single partition or separating wall 13, referred to hereinafter for the sake of brevity as the partition, which extends completely axially and radially through the interior of the tube body portion 11, which may be referred to hereinafter for the sake of brevity as the body portion 11, and the tube head 12, which may be referred to hereinafter for the sake of brevity as the head 12. In FIG. 1 reference 15 denotes a part of the partition 13, which engages through the passage of the head 12.

Body portions 11 for tubes 10 designed in accordance with the invention are preferably produced from plastic films or sheets. The materials for same can be single-layer and multi-layer films and sheets (laminate), polyethylene, of low or high density, polypropylene, ethylene and propylene copolymers, polyethylene terephthalate (PET) and polyamides.

Laminates as films or sheets for body portions 11 are often used when the packaged substance has constituents which can go into a gaseous phase and which are to be prevented from diffusing through the wall of the body portion. The same applies if for example oxygen, by diffusing from the exterior through a wall of the tube body portion, is to be prevented from gaining access to the packaged substance in the tube.

For that purpose such laminates include a gas-barrier layer which is in the form of a film or sheet, comprising ethylene vinyl alcohol, polyamide, polyvinylidene chloride, PET or a metal material, for example and preferably aluminum, which is lined on one or both sides with one of the above-mentioned plastic materials, that is to say polyethylene, polypropylene and so forth, that is to say, being coated in sheet form. This choice of sheet material for the body portion 11, that is to say single-layer plastic sheet or film or laminate with and without a barrier layer, also applies in regard to the wall 13 if diffusion of oxygen and packaged substance components which have become gaseous from one chamber to another is to be prevented.

The body portion 11 is produced by bending over a strip of sheet or film to form a tube with subsequent longitudinal seam welding for the ends of the strip, on which the head 12 is shaped. For that reason it is important for the plastic material of a single-layer film or sheet or that of a lining of a laminate material to be well weldable. Instead of a longitudinal seam weld it is also possible to produce a plastic tube body portion by extrusion, although without a metallic barrier layer.

The head 12 is shaped on the body portion 11 of the tube in the case of the tubes 10 in accordance with the invention. That can be effected in three different ways.

FIG. 2 shows as a detail a prefabricated head 12 with a peripherally extending annular connecting flange 16 with which the head 12 is fitted into an open end 16*a* of the body portion 11 and connected to the latter. The connection is made by fusing the corresponding tube end 16*a* to the connecting surface 16 by the application of heat, involving fusion connection of the connecting surface 16 and the internal surface of the tube body portion 11, and pressure whereby the surfaces which have been caused to initially melt flow one into the other.

A second way of shaping the head 12 involves injection molding, as indicated in FIG. 3. In that case one end of the body portion 16*a* is introduced into the injection molding mold and during the head forming operation connected thereto.

The shaping procedure involving press shaping takes place in a manner which is comparable to the injection molding procedure, the difference being that the body portion 11 is shaped on a head 12 which is in the course of being formed while a portion of plasticised plastic material is shaped in a mold to form a head 12.

The plastic materials of the head 12 and the body portion 11 or lining material should be the same or at least compatible, for the purposes of producing fluid-tight seams, that is to say they should melt and make the transition into fluid or pasty states which permit them to flow one into the other at a head weld seam as indicated in FIG. 3, in the same melting ranges.

Adjoining the connecting surface 16 in the case of the prefabricated head 12 in FIG. 2 is a tube shoulder 17 which may be referred to for the sake of brevity as the shoulder 17 and from which projects the nozzle 18 which on its outer periphery carries a screwthread 19 or another device for connection of a closure cap (not shown) to the nozzle 18.

As shown in FIG. 3 extending through the nozzle 18 is a nozzle passage 14 with at one end a nozzle opening 21 and at the other end a passage entrance 22. As shown in FIG. 3 the shoulder 17 has a shoulder space 23 from which packaged substance is conveyed into the passage entrance 22.

Referring now to FIG. 6, starting from the tube closure seam 25 for closing the body portion 11 at the bottom end at which the tube 10 is filled with the substances to be packaged therein, which seam 25 may be referred to as the crimp 25 for the sake of brevity, the partition 13 extends through the internal space 20 of the tube body portion 11, the shoulder space 23 of the head 12 and the nozzle passage 14. Preferably the partition 13 is shaped at one end, being at the lower end of the body portion 11 forming the filling opening, into the crimp 25 which closes that end after the chambers have been filled with packaged substances. The crimp 25 is formed for example by a procedure whereby wall parts at the filling end of the body portion 11 are brought together, with the end part of the partition 13 disposed therebetween, and welded jointly by means of heat and pressure.

The crimp 25 and a line extending longitudinally through the body portion 11 perpendicularly with respect to the crimp 25, for example the axial center line indicated at M in FIG. 7 of the body portion 11, define a plane constituting a reference plane which extends axially and radially through the tube 10 and in which the partition 13 is generally disposed, starting from the crimp 25 and extending through the internal space 20 of the body portion 11, the shoulder space 23 of the head 12 and the nozzle passage 14. FIGS. 7 and 8 show a wall 13 in an installation position as described hereinbefore, referred to hereinafter as the parallel installation position insofar as the partition extends parallel to the reference plane.

FIG. 10 shows a wall 13 which is intended for assembly to the body portion 11 and the head 12 to form the partition. The wall includes a tube body portion part 26, a head part 27 and the part 15. The width at the upper wide side 29 and the lower wide side 30 of the tube body portion part 26 corresponds, without dimensional details, to the tube diameter while the length at the longitudinal sides 31 of the tube body portion part 26 corresponds to the length of the axial center line of the body portion 11. Adjoining the upper wide side 29 is the head part 27 whose longitudinal sides 32 converge at an angle relative to the upper wide side 29 to the part 15. The length and the angular configuration of the longitudinal sides 32 correspond to the length and angular configuration of the surface of the tube shoulder 17, which faces towards the interior of the tube. The longitudinal sides 33 and the wide sides 34 of the part 15 correspond to the length and the diameter of the nozzle passage 14.

Adjoining each of the longitudinal sides 31 of the tube body portion part 26 are portions providing flaps 35 which correspond to the length of the longitudinal sides 31 and which are of smaller extent than the wide sides 29, 30 and which, bent over in opposite relationship parallel to the longitudinal sides 31, 32, are intended to hold the partition 13, as a possible design configuration of the invention, in regard to the tube body portion part 26 in fixed engagement as by welding or in releasable engagement as by spring-biased contact with the surface of the internal space 20 of the tube body portion 11.

FIGS. 6 and 7 show a partition 13 which is accommodated in the tube and which, disposed in the reference plane, that is to say in the parallel installation position, engages through the body portion 11, in engagement with the internal surface of the body portion 11.

FIGS. 4 and 5 show a head 12 with a part 15 in the nozzle passage 14 in the parallel installation position, wherein the part 15 separates nozzle openings 21*a* and 21*b* of different cross-sections from each other. Those cross-sections can be half-round or polygonal. It has been found that, with different cross-sections, in a development of the invention, it is possible to cause the component discharge from a tube 10 to be rendered uniform.

In accordance with the invention, the discharge of packaged material from the tube can be rendered uniform if the partition 13 passes through the tube 10 in a non-parallel installation position, in relation to the reference plane. Figure 9 shows a part of the partition 13, which is in the nozzle passage 14 in a non-parallel installation position. The crimp 25 coincides with the lower wide side 30 in Figure 10 of the body portion part 26, that is to say, the lower wide side 30 as described in connection with the parallel installation position is accommodated in the crimp 25 which after being formed is disposed on a diametral line of the body portion 11. From the crimp 25 with wide side 30, which is thus positioned invariably about the center line M, the partition 13 extends in an axial direction in a position of progressively twisting or rotating with increasing angles around the center line in a direction towards the head 12 so that, in the end position, as shown in FIG. 9, the wide side 30 in the crimp 25 and the wide side 29 of the tube body portion part 26 are disposed at an angle relative to each other, wherein the angular positioning for the head part 27 and the nozzle part 15 continues rising in degrees of angle relative to the crimp 25. In accordance with the invention a deflection for example of the wide side 34 of the part 15 of the partition 13, at the respective ends thereof, with respect to the crimp 25, around a common center line M, of the order of magnitude of $\alpha$=between 5 and 35 degrees, preferably between 28 and 32 degrees, is preferred. The crimp 25 and the part 15 of the partition 13 include between them the angle $\alpha$ indicated in FIG. 9 of the indicated magnitude.

It was found that the partition 13 which is twisted through the indicated degrees of angle imparts to the packaged substance to be removed a slight twist movement or partial rotation which advantageously contributes to rendering the discharge of substance uniform, when fluctuating pressure loadings are involved.

The effectiveness of the above-described partially twisted configuration of the partition 13, in terms of rendering the discharge of packaged substance uniform, can be further enhanced if the partition 13 of a tube 10 is made from a material which is stiffer than the material of the body portion 11. Comparative investigations were undertaken to determine the degrees of stiffness of the materials being compared in the situation according to the invention in regard to the plastic materials used. Film or sheet strips of identical dimensions (length, width, thickness) were put on to two spaced-apart supports and centrally subjected to an equal loading between the supports. The loading caused flexing of the film or sheet strip, and in comparison with the load-free condition it formed a bend line with a maximum degree of flex or deflection relative to the horizontal, which was between the supports. A film or sheet material which was intended to produce a partition 13 or the film or sheet, was deemed to be stiff or stiffer if, with a loading applied, its deflection was between 15% and 55%, preferably between 25% and 50%, of the deflection which was measured for the film or sheet material for the tube 11 under the same test conditions. In accordance with the invention, in conjunction with the different stiffness, the thickness (gauge) of the films or sheets for the body portion 11 and the partition 13 is also to be different. Advantageously the body portion film or sheet thickness is to be selected from a thickness range of between 100 $\mu$m and 400 $\mu$m, preferably from a range of between 250 $\mu$m and 300 $\mu$m. For the partitions, thicknesses from a range of between 160 $\mu$m and 400 $\mu$m, preferably between 180 $\mu$m and 250 $\mu$m, are advantageous.

What is claimed is:

1. A multi-chamber tube for packaging and component-wise dispensing of packaged substances, comprising:

a deformable tube body portion of plastic sheet about an axial center line and having first and second ends, a tube head at the first end of the body portion and having a closeable nozzle, a closure at the second end of the body portion and closing the opening of the tube thereat, and at least one partition of material in sheet form which extends from the second end of the body portion to the first end of the body portion, the tube head and the closable nozzle, in a progressively twisting manner in increasing angles around the axial center line.

2. A multi-chamber tube as set forth in claim 1 wherein said partition part in said nozzle passage has a widthwise side which includes with the closure an angle of the order of magnitude of between 5 and 35 degrees.

3. A multi-chamber tube as set forth in claim 2 wherein the angle is between 28 and 32 degrees.

* * * * *